US007926202B2

(12) United States Patent
Dittmer et al.

(10) Patent No.: US 7,926,202 B2
(45) Date of Patent: Apr. 19, 2011

(54) CONDENSER TUMBLE-DRYER

(75) Inventors: Lothar Dittmer, Berlin (DE); Holger Löffler, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 876 days.

(21) Appl. No.: 11/886,403

(22) PCT Filed: Jan. 17, 2006

(86) PCT No.: PCT/EP2006/050250

§ 371 (c)(1),
(2), (4) Date: Sep. 13, 2007

(87) PCT Pub. No.: WO2006/097369

PCT Pub. Date: Sep. 21, 2006

(65) Prior Publication Data

US 2008/0189973 A1 Aug. 14, 2008

(30) Foreign Application Priority Data

Mar. 18, 2005 (DE) ..... 10 2005 013 051

(51) Int. Cl.
*F26B 11/02* (2006.01)

(52) U.S. Cl. ..... 34/595; 34/601; 34/606; 34/610; 68/18 C; 68/18 R; 15/40; 165/104.19; 165/158; 8/149.3; 8/158; 62/421; 705/7; 705/14

(58) Field of Classification Search ..... 34/595, 34/601, 602, 603, 606, 610; 68/18 C, 18 R; 15/40; 165/104.19, 158; 8/149.3, 158; 62/421; 705/7, 14

See application file for complete search history.

(56) References Cited

U.S. PATENT DOCUMENTS

| | | | | |
|---|---|---|---|---|
| 2,114,776 | A * | 4/1938 | Davis | 68/18 R |
| 2,477,383 | A * | 7/1949 | Lewis | 510/418 |
| 2,631,980 | A * | 3/1953 | Lewis | 510/452 |
| 2,681,556 | A * | 6/1954 | Creighton et al. | 68/18 R |
| 2,686,412 | A * | 8/1954 | Ricigliano et al. | 68/18 R |

(Continued)

FOREIGN PATENT DOCUMENTS

DE 31 35 292 3/1983

(Continued)

OTHER PUBLICATIONS

International Search Report PCT/EP2006/050250.

*Primary Examiner* — Stephen M. Gravini

(74) *Attorney, Agent, or Firm* — James E. Howard; Andre Pallapies

(57) ABSTRACT

A base module for a condenser tumble dryer housing the functional parts and air conduction components and additionally being configured as part of the support structure of the tumble dryer. The base module comprises perpendicular joint faces in relation to the front end shield and the rear process air cover. The joint faces lie essentially on at least one perpendicular plane or on at least two perpendicular planes that are offset in a staggered manner in relation to one another, have a large surface area and preferably extend over the entire width of the tumble dryer. The proposed base module has significant advantages in terms of its mechanical stability as an individual structural component and as part of the entire support structure and in terms of the effective conduction of the air streams, the production of the individual parts and the assembly of the final module.

19 Claims, 1 Drawing Sheet

U.S. PATENT DOCUMENTS

| | | | | | |
|---|---|---|---|---|---|
| 2,688,806 | A * | 9/1954 | Long | 34/75 |
| 2,743,533 | A * | 5/1956 | Smith | 34/547 |
| 2,752,694 | A * | 7/1956 | McCormick | 34/60 |
| 2,817,157 | A * | 12/1957 | McCormick | 34/82 |
| 2,885,789 | A * | 5/1959 | Conkling et al. | 34/547 |
| 2,893,135 | A * | 7/1959 | Smith | 34/610 |
| 2,957,330 | A * | 10/1960 | Cline | 68/20 |
| 3,032,887 | A * | 5/1962 | Whyte et al. | 34/524 |
| 3,064,360 | A * | 11/1962 | Sholin | 34/91 |
| 3,103,112 | A * | 9/1963 | Behrens et al. | 68/18 R |
| 3,106,831 | A * | 10/1963 | Behrens | 68/12.08 |
| 3,113,004 | A * | 12/1963 | Shaw | 34/95 |
| 3,161,481 | A * | 12/1964 | Edwards | 34/527 |
| 3,162,032 | A * | 12/1964 | Behrens | 68/18 F |
| 3,186,104 | A * | 6/1965 | Stilwell, Jr. | 34/527 |
| 3,197,886 | A * | 8/1965 | Brame et al. | 34/90 |
| 3,206,950 | A * | 9/1965 | Xeros | 68/12.09 |
| 3,250,081 | A * | 5/1966 | Othmer | 62/535 |
| 3,250,097 | A * | 5/1966 | Czech | 68/12.09 |
| 3,254,513 | A * | 6/1966 | Gosnell | 68/12.08 |
| 3,270,531 | A * | 9/1966 | Czech | 68/18 F |
| 3,273,256 | A * | 9/1966 | Behrens | 34/546 |
| 3,274,807 | A * | 9/1966 | Czech | 68/12.09 |
| 3,283,548 | A * | 11/1966 | Czech | 68/12.08 |
| 3,364,592 | A * | 1/1968 | Nighswander et al. | 34/601 |
| 3,387,385 | A * | 6/1968 | Mandarino, Jr. et al. | 34/596 |
| 3,486,529 | A * | 12/1969 | Geibel | 137/625.4 |
| 3,584,394 | A * | 6/1971 | Grabek | 34/599 |
| 3,605,281 | A * | 9/1971 | Hubbard et al. | 34/599 |
| 3,721,015 | A * | 3/1973 | Sisler et al. | 34/601 |
| 3,828,445 | A * | 8/1974 | Smoot | 34/242 |
| 3,959,891 | A * | 6/1976 | Burkall | 34/82 |
| 4,073,663 | A * | 2/1978 | Lundgren | 134/10 |
| 4,112,590 | A * | 9/1978 | Muller | 34/75 |
| 4,154,003 | A * | 5/1979 | Muller | 34/469 |
| 4,305,768 | A * | 12/1981 | Lontz | 156/64 |
| 4,338,731 | A * | 7/1982 | Shames et al. | 34/82 |
| 4,538,899 | A * | 9/1985 | Landa et al. | 399/156 |
| 4,544,493 | A * | 10/1985 | Silvis | 510/537 |
| 4,586,269 | A * | 5/1986 | St. Louis | 34/601 |
| 5,072,526 | A * | 12/1991 | Hirota et al. | 34/60 |
| 5,115,633 | A * | 5/1992 | Priser et al. | 60/39.01 |
| 5,199,997 | A * | 4/1993 | Stowe | 134/25.1 |
| 5,203,998 | A * | 4/1993 | Benian | 210/493.5 |
| 5,216,823 | A * | 6/1993 | Ripley | 34/601 |
| 5,228,212 | A * | 7/1993 | Turetta et al. | 34/493 |
| 5,246,782 | A * | 9/1993 | Kennedy et al. | 428/421 |
| 5,301,880 | A * | 4/1994 | Benian | 239/557 |
| 5,409,777 | A * | 4/1995 | Kennedy et al. | 428/411.1 |
| 5,438,773 | A * | 8/1995 | Chaffee | 34/61 |
| 5,452,045 | A * | 9/1995 | Koboshi et al. | 396/626 |
| 5,495,681 | A * | 3/1996 | Paradis | 34/602 |
| 5,510,029 | A * | 4/1996 | Benian | 210/333.01 |
| 5,555,647 | A * | 9/1996 | Torborg et al. | 34/601 |
| 5,636,453 | A * | 6/1997 | Stacik et al. | 34/601 |
| 5,662,050 | A * | 9/1997 | Angelo et al. | 110/246 |
| 5,664,340 | A * | 9/1997 | Brown | 34/275 |
| 5,667,683 | A * | 9/1997 | Benian | 210/409 |
| 5,730,922 | A * | 3/1998 | Babb et al. | 264/258 |
| 5,768,730 | A * | 6/1998 | Matsumoto et al. | 8/159 |
| 5,827,329 | A * | 10/1998 | Champeau | 8/142 |
| 6,293,121 | B1 * | 9/2001 | Labrador | 62/304 |
| 6,312,528 | B1 * | 11/2001 | Summerfield et al. | 134/40 |
| 6,327,994 | B1 * | 12/2001 | Labrador | 114/382 |
| 6,572,910 | B2 * | 6/2003 | Lanner et al. | 426/438 |
| 6,641,796 | B2 * | 11/2003 | Micco et al. | 423/700 |
| 6,830,767 | B2 * | 12/2004 | Teras et al. | 426/439 |
| 6,938,356 | B2 * | 9/2005 | Nagae et al. | 34/77 |
| 6,968,632 | B2 * | 11/2005 | Guinibert et al. | 34/602 |
| 6,984,948 | B2 * | 1/2006 | Nakata et al. | 318/400.02 |
| 6,993,930 | B2 * | 2/2006 | Blackstone | 62/421 |
| 7,024,795 | B2 * | 4/2006 | Tadano et al. | 34/76 |
| 7,024,802 | B2 * | 4/2006 | Myung | 34/604 |
| 7,036,243 | B2 * | 5/2006 | Doh et al. | 34/595 |
| 7,065,905 | B2 * | 6/2006 | Guinibert et al. | 34/603 |
| 7,121,018 | B2 * | 10/2006 | Lee | 34/595 |
| 7,220,365 | B2 * | 5/2007 | Qu et al. | 252/70 |
| 7,225,562 | B2 * | 6/2007 | Guinibert et al. | 34/601 |
| 7,257,905 | B2 * | 8/2007 | Guinibert et al. | 34/82 |
| 7,263,861 | B2 * | 9/2007 | Yabuuchi et al. | 68/12.15 |
| 7,266,965 | B2 * | 9/2007 | Blackstone | 62/259.3 |
| 7,266,966 | B2 * | 9/2007 | Blackstone | 62/259.3 |
| 7,340,849 | B2 * | 3/2008 | Kim | 34/602 |
| 7,367,206 | B2 * | 5/2008 | Asada et al. | 68/18 F |
| 7,409,776 | B2 * | 8/2008 | Ono et al. | 34/77 |
| 7,412,853 | B2 * | 8/2008 | Hong et al. | 68/19.1 |
| 7,421,865 | B2 * | 9/2008 | Lee et al. | 68/15 |
| 7,444,843 | B2 * | 11/2008 | Ozturk et al. | 68/142 |
| 7,467,483 | B2 * | 12/2008 | Guinibert et al. | 34/601 |
| 7,504,784 | B2 * | 3/2009 | Asada et al. | 318/51 |
| 7,506,458 | B2 * | 3/2009 | Lee et al. | 34/601 |
| 7,513,132 | B2 * | 4/2009 | Wright et al. | 68/18 F |
| 7,534,304 | B2 * | 5/2009 | Conrad et al. | 134/10 |
| 7,579,798 | B2 * | 8/2009 | Hosoito et al. | 318/400.02 |
| 7,603,878 | B2 * | 10/2009 | Fyvie | 68/18 R |
| 7,640,678 | B2 * | 1/2010 | Lee et al. | 34/601 |
| 7,694,434 | B2 * | 4/2010 | Lee | 34/607 |
| 7,695,524 | B2 * | 4/2010 | Wright et al. | 8/142 |
| 7,707,860 | B2 * | 5/2010 | Hong et al. | 68/19 |
| 7,762,007 | B2 * | 7/2010 | Guinibert et al. | 34/601 |
| 7,771,699 | B2 * | 8/2010 | Adams et al. | 423/484 |
| 7,805,856 | B2 * | 10/2010 | Gaβmann et al. | 34/85 |
| 2001/0053741 | A1 * | 12/2001 | Micco et al. | 502/79 |
| 2002/0018837 | A1 * | 2/2002 | Lanner et al. | 426/560 |
| 2002/0018838 | A1 * | 2/2002 | Zimmerman et al. | 426/560 |
| 2002/0022076 | A1 * | 2/2002 | Lanner et al. | 426/560 |
| 2002/0023662 | A1 * | 2/2002 | Summerfield et al. | 134/1 |
| 2002/0028273 | A1 * | 3/2002 | Teras et al. | 426/439 |
| 2002/0034571 | A1 * | 3/2002 | Zimmerman et al. | 426/549 |
| 2002/0083615 | A1 * | 7/2002 | Giblin et al. | 34/595 |
| 2003/0050219 | A1 * | 3/2003 | Micco et al. | 510/507 |
| 2003/0066638 | A1 * | 4/2003 | Qu et al. | 165/186 |
| 2003/0079368 | A1 * | 5/2003 | Hoffman | 34/202 |
| 2003/0089138 | A1 * | 5/2003 | Kawamura et al. | 68/17 R |
| 2004/0045096 | A1 * | 3/2004 | Mani et al. | 8/142 |
| 2004/0065125 | A1 * | 4/2004 | Asada et al. | 68/12.09 |
| 2004/0079121 | A1 * | 4/2004 | Yabuuchi et al. | 68/19.2 |
| 2004/0112095 | A1 * | 6/2004 | Bolduan et al. | 68/5 C |
| 2004/0117919 | A1 * | 6/2004 | Conrad et al. | 8/137 |
| 2004/0124807 | A1 * | 7/2004 | Nakata et al. | 318/801 |
| 2004/0139555 | A1 * | 7/2004 | Conrad et al. | 8/137 |
| 2004/0168459 | A1 * | 9/2004 | Blackstone | 62/259.2 |
| 2005/0016199 | A1 * | 1/2005 | Blackstone | 62/420 |
| 2005/0044744 | A1 * | 3/2005 | Tadano et al. | 34/596 |
| 2005/0076535 | A1 * | 4/2005 | Guinibert et al. | 34/601 |
| 2005/0086827 | A1 * | 4/2005 | Nagae et al. | 34/218 |
| 2005/0091755 | A1 * | 5/2005 | Conrad et al. | 8/137 |
| 2005/0091756 | A1 * | 5/2005 | Wright et al. | 8/137 |
| 2005/0092352 | A1 * | 5/2005 | Luckman et al. | 134/42 |
| 2005/0115104 | A1 * | 6/2005 | Guinibert et al. | 34/601 |
| 2005/0132594 | A1 * | 6/2005 | Doh et al. | 34/73 |
| 2005/0132600 | A1 * | 6/2005 | Myung | 34/601 |
| 2005/0132757 | A1 * | 6/2005 | Lee et al. | 68/15 |
| 2005/0138831 | A1 * | 6/2005 | Lee | 34/73 |
| 2005/0150059 | A1 * | 7/2005 | Luckman et al. | 8/137 |
| 2005/0155393 | A1 * | 7/2005 | Wright et al. | 68/3 R |
| 2005/0160771 | A1 * | 7/2005 | Hosoito et al. | 68/12.16 |
| 2005/0178138 | A1 * | 8/2005 | Blackstone | 62/259.3 |
| 2005/0198851 | A1 * | 9/2005 | Tomochika et al. | 34/74 |
| 2005/0198852 | A1 * | 9/2005 | Ono et al. | 34/77 |
| 2005/0204755 | A1 * | 9/2005 | Nishiwaki et al. | 62/93 |
| 2005/0246920 | A1 * | 11/2005 | Yabuuchi et al. | 34/515 |
| 2005/0268483 | A1 * | 12/2005 | Park et al. | 34/603 |
| 2006/0041448 | A1 * | 2/2006 | Patterson et al. | 705/1 |
| 2006/0059632 | A1 * | 3/2006 | Fyvie | 8/158 |
| 2006/0080819 | A1 * | 4/2006 | McAllister | 29/403.3 |
| 2006/0096335 | A1 * | 5/2006 | Park et al. | 68/20 |
| 2006/0123853 | A1 * | 6/2006 | Hong et al. | 68/19 |
| 2006/0123854 | A1 * | 6/2006 | Hong et al. | 68/19.1 |
| 2006/0218817 | A1 * | 10/2006 | Lee | 34/604 |
| 2007/0006477 | A1 * | 1/2007 | Guinibert et al. | 34/85 |
| 2007/0062513 | A1 * | 3/2007 | Gagas | 126/299 D |
| 2007/0098625 | A1 * | 5/2007 | Adams et al. | 423/484 |
| 2007/0107250 | A1 * | 5/2007 | Gassmann et al. | 34/82 |
| 2007/0107251 | A1 * | 5/2007 | Goldberg et al. | 34/82 |
| 2007/0145941 | A1 * | 6/2007 | Asada et al. | 318/811 |
| 2007/0186440 | A1 * | 8/2007 | Guinibert et al. | 34/603 |

2007/0207186 A1* 9/2007 Scanlon et al. ..... 424/424
2007/0220776 A1* 9/2007 Guinibert et al. ..... 34/603
2008/0000098 A1* 1/2008 Choi et al. ..... 34/114
2008/0066484 A1* 3/2008 Blackstone ..... 62/421
2008/0104862 A1* 5/2008 Dittmar et al. ..... 34/601
2008/0141550 A1* 6/2008 Bae et al. ..... 34/68
2008/0148494 A1* 6/2008 Son et al. ..... 8/149.3
2008/0163510 A1* 7/2008 Dittmar et al. ..... 34/108
2008/0168679 A1* 7/2008 Son et al. ..... 34/497
2008/0170982 A1* 7/2008 Zhang et al. ..... 423/447.3
2008/0184585 A1* 8/2008 Yoo et al. ..... 34/427
2008/0189973 A1* 8/2008 Dittmer et al. ..... 34/76
2008/0189974 A1* 8/2008 Dittmer et al. ..... 34/132
2008/0209954 A1* 9/2008 Nakiri ..... 68/12.15
2008/0235977 A1* 10/2008 Kuwabara ..... 34/77
2008/0276656 A1* 11/2008 Kitamura et al. ..... 68/12.13
2008/0313922 A1* 12/2008 Bae et al. ..... 34/491
2009/0000184 A1* 1/2009 Garwood ..... 44/307
2009/0044932 A1* 2/2009 Blackstone ..... 165/158
2009/0054290 A1* 2/2009 Fernholz et al. ..... 510/234
2009/0062581 A1* 3/2009 Appel et al. ..... 585/241
2009/0071031 A1* 3/2009 Kim ..... 34/140
2009/0083990 A1* 4/2009 Bae et al. ..... 34/486
2009/0094852 A1* 4/2009 Tatsumi et al. ..... 34/132
2009/0113745 A1* 5/2009 Choi et al. ..... 34/139
2009/0113755 A1* 5/2009 Choi et al. ..... 34/390
2009/0126222 A1* 5/2009 Bae et al. ..... 34/527
2009/0126420 A1* 5/2009 Tsunemine et al. ..... 68/5 C
2009/0126423 A1* 5/2009 Bae et al. ..... 68/5 C
2009/0133281 A1* 5/2009 Yoon et al. ..... 34/72
2009/0139107 A1* 6/2009 Grunert et al. ..... 34/86
2009/0158928 A1* 6/2009 Wu et al. ..... 95/115
2009/0172967 A1* 7/2009 Son et al. ..... 34/318
2009/0215000 A1* 8/2009 Boots et al. ..... 432/118
2009/0226308 A1* 9/2009 Vandor ..... 415/178
2009/0229141 A1* 9/2009 Nawrot et al. ..... 34/467
2009/0255299 A1* 10/2009 Hiro et al. ..... 68/19
2009/0265953 A1* 10/2009 Bae et al. ..... 34/467
2009/0277035 A1* 11/2009 Choi et al. ..... 34/130
2009/0288456 A1* 11/2009 Bae et al. ..... 68/5 R
2009/0320319 A1* 12/2009 Grunert et al. ..... 34/467
2010/0000117 A1* 1/2010 Choi et al. ..... 34/443
2010/0005679 A1* 1/2010 Goldberg et al. ..... 34/82
2010/0005681 A1* 1/2010 Jo et al. ..... 34/215
2010/0011605 A1* 1/2010 Kim et al. ..... 34/60
2010/0011606 A1* 1/2010 Kim et al. ..... 34/60
2010/0011607 A1* 1/2010 Kim et al. ..... 34/60
2010/0011608 A1* 1/2010 Grunert et al. ..... 34/85
2010/0011611 A1* 1/2010 Kim et al. ..... 34/390
2010/0050701 A1* 3/2010 Boriani et al. ..... 68/18 F
2010/0058605 A1* 3/2010 Kang ..... 34/85
2010/0071224 A1* 3/2010 Chung ..... 34/218
2010/0077787 A1* 4/2010 Masuda et al. ..... 62/324.5
2010/0101606 A1* 4/2010 Grunert ..... 134/11
2010/0115784 A1* 5/2010 Jo et al. ..... 34/132
2010/0115785 A1* 5/2010 Ben-Shmuel et al. ..... 34/260
2010/0130676 A1* 5/2010 Suzuki et al. ..... 524/599
2010/0139366 A1* 6/2010 Krausch ..... 73/23.34
2010/0146809 A1* 6/2010 Grunert et al. ..... 34/443
2010/0146812 A1* 6/2010 Ahn et al. ..... 34/480
2010/0154454 A1* 6/2010 Blackstone ..... 62/259.3
2010/0175432 A1* 7/2010 Komori et al. ..... 68/20
2010/0206248 A1* 8/2010 Mok ..... 122/17.1
2010/0212178 A1* 8/2010 Corberan Salvador et al. 34/108
2010/0212369 A1* 8/2010 Grunert et al. ..... 68/13 R
2010/0275457 A1* 11/2010 Balerdi Azpilicueta et al. . 34/86
2010/0293804 A1* 11/2010 Nawrot et al. ..... 34/86
2010/0319146 A1* 12/2010 Goldberg et al. ..... 15/40
2010/0322819 A1* 12/2010 Kim et al. ..... 422/5

FOREIGN PATENT DOCUMENTS

DE 3148573 A1 * 6/1983
DE 4009102 A1 * 9/1991
DE 4011507 A1 * 12/1991
DE 4434205 A1 * 3/1996
DE 198 11 962 9/1999
DE 102 02 442 8/2003
EP 0 434 169 6/1991
EP 0 481 187 4/1992
EP 1391550 A1 * 2/2004
EP 1 508 636 2/2005
EP 1 548 178 6/2005
EP 1 595 994 11/2005
EP 1710339 A1 * 10/2006
GB 2110251 A * 6/1983
GB 2184217 A * 6/1987
JP 60238696 A * 11/1985
JP 01151495 A * 6/1989
JP 02026597 A * 1/1990
JP 03218800 A * 9/1991
JP 03280997 A * 12/1991
JP 04075697 A * 3/1992
JP 04126196 A * 4/1992
JP 04152970 A * 5/1992
JP 04200590 A * 7/1992
JP 04240494 A * 8/1992
JP 08252395 A * 10/1996
JP 09173697 A * 7/1997
JP 10005496 A * 1/1998
JP 10033896 A * 2/1998
JP 10211383 A * 8/1998
JP 11164996 A * 6/1999
JP 2002200395 A * 7/2002
JP 2004229954 A * 8/2004
JP 2005095632 A * 4/2005
JP 2005124763 A * 5/2005
JP 2007143712 A * 6/2007
WO WO 9207989 A1 * 5/1992
WO WO 0047810 A1 * 8/2000

* cited by examiner

CONDENSER TUMBLE-DRYER

The present invention relates to a condenser tumble-dryer having facilities for accommodating the following components: an air-cooled condenser with a heat-exchanger, a drive motor for a clothes drum and for a fan for the process air and the cooling air, ducts and conduit facilities for both air-streams, a condensate collection tray and a condensate pump, and having a base module that is made of plastic and serves as part of the basic design of the tumble-dryer, into which base module said accommodating facilities are molded.

BACKGROUND OF THE INVENTION

Such a condenser tumble-dryer has an at least approximately horizontally aligned and rotatably mounted clothes drum, two separate systems for the cooling air flow and the process air flow, a motor for driving the fan and clothes drum, an electric heating unit to heat up the process air, a condenser having a heat exchanger in which the process air is cooled and the moisture absorbed by the load to be dried is extracted by condensation, and facilities for removing the condensate.

Condenser tumble-dryers generally include a closed circuit for the process air ducting. During a drying process, the load to be dried is moved around in the rotatable drum and the heated process air is directed onto it, the air being blown in through apertures in the rear wall of the drum and flowing through the clothes drum in a roughly axial direction from the rear wall of the drum towards the front. The process air passes through a lint screen in the region around the loading aperture and reaches the condenser where the process air in the heat condenser is cooled by cooling air that has been sucked in from outside and condenses the moisture absorbed by the drying load. The condensate that has been collected in a collection container is removed using a pump. The process air that has been cooled and dehumidified in the heat exchanger is conveyed into the inside of the drum again via the heating element. The cooling air and process air are each conveyed by a fan, which is usually driven by the drive motor of the clothes drum.

In known tumble-dryers, mainly for reasons of space, a number of operationally necessary functional sub-assemblies and components, such as the drive motor, the fans for the cooling air and process air, the condenser, the condensate collection tray and pump and also facilities for conveying and ducting the process air and cooling air are integrated in a sub-assembly and installed underneath the clothes drum as a base module in the base area of the tumble-dryer.

Such a base module must be dimensioned in such a way that it can accommodate the components and must have sufficient mechanical stability in order to keep the installed components safe. The functional sub-assemblies and components have to be configured and assigned to each other such that their function can be used as effectively as possible in the operation of the tumble-dryer. The closed process air circuit system should be sealed off with minimum resistance in the air ducting so that energy losses and the escape of moisture can be avoided. In order to achieve this, in addition to corresponding air ducting in the base module, in particular the separation points from the end plate, which plate serves among other things to provide bearings at the front of the clothes drum and from the rear process air duct in which the heat register is generally disposed should be designed to be as air-tight as possible. Seal rings or seal cuffs are generally used for this purpose at the separation points of the sub-assemblies. The connections are, for example, mechanically secured with threaded joints such that they withstand the continuous stresses in long term operation.

In addition to the functional requirements, in the design of a base module aspects of rational manufacturing should be considered and where necessary balanced one against another. This affects in particular the manufacturing of the individual parts, which are made mainly of plastic by the injection molding process, but also the ease with which they can be fitted together during final assembly.

The prior art has disclosed various solutions for such base modules, depending on the purpose and on the focus of the design. In a base sub-assembly described in EP 0 434 169 A2, the functional parts are firmly mounted on a load-bearing unit that incorporates the base surface of the dryer. The housings for the fan wheels of the cooling air flow and process air flow are disposed symmetrically on both sides of the motor. The housings for the fan wheels each consist of two shells which are connected to each other by an integral hinge. The lower shells of the housings are mounted on to the load-bearing unit. After fitting the motor and putting in the fan wheels, the two collapsible upper parts are connected to the lower parts by a simple tilting movement and the fan housings are sealed in this way.

Even if the individual parts used for the air ducting are still easy to fit, maintaining a sufficient air-tightness of the air ducts is rather problematic in the construction method described. This applies in particular to the process air supply but also to the fan housings and the accommodation for the condenser.

The cited publication discloses air conduction facilities fixed onto the condenser at the sides to duct the process air and to separate the cooling air flow and process air flow. It is only with fairly considerable effort that it is possible to make said conduction facilities airtight such that the mixing of process air and cooling air and the escape of moisture into the room where the dryer is set up can be avoided.

DE 102 02 442 A1 discloses a push-in unit for a base module with allegedly improved air ducting. The apertures for the intake and outlet of cooling air are located in the area at the front of the tumble-dryer. The base module is pushed from the front into the frame of the housing as a prefabricated sub-assembly and secured in place. Integrated in the base module are spaces to accommodate the condenser, the cooling air fan and process air fan and air ducting and conduction ducts for the ducting of cooling air and process air. The front section of the process air duct is inserted from above, and the point of separation thereof is disposed in a roughly horizontal manner. The tumble-dryer is intended to achieve mechanical stability from the self-supporting housing which has a framework design. The combination of a metal frame and plastic base part is intensive in the use of materials, however, and presents problems during assembly because of the joining methods used.

A self-supporting base sub-assembly configured as part of the whole supporting structure is also known from DE 31 35 292 C2. This sub-assembly is made of plastic and is designed as a base part that fills the whole of the base area of the tumble-dryer, which base part forms the supporting structure together with an intermediate base and an upper part disposed one on top of the other. Molded into said base part are spaces to accommodate the functional parts and facilities for ducting the process air and cooling air. Said base part is part of the supporting structure of the device and in the base area it replaces the usual cross-struts and supporting rails. Corner posts are molded into the base part to provide connection to the housing, which is formed from a frame, said corner posts being joined to the perpendicular corner sections of the frame.

This combination of a metal frame and plastic base part is very intensive in the use of materials and presents problems during assembly when connecting the load-bearing structure and the air ducts.

EP 1 508 636 A2 discloses an air suction device of a tumble-dryer, which device includes a housing that has on one side an air suction port to introduce external air; furthermore it has a fan that is built into the housing to generate the suction force; a drive motor to drive the fan, a guide duct to direct to a condensing device the air that has been sucked in; and a ventilation grille which is installed with a certain clearance from one side face of the housing, the suction port being disposed such that a duct can be formed between the ventilation grille and the lateral surface. The ventilation grille is equipped with a plurality of grille plates. The air suction device is at the same time used as a supporting stand for the part of the housing that is located above.

Furthermore, the aforementioned solutions share the common drawback that, in order to avoid energy losses and the escape of moisture, additional seals have to be inserted at the separation points of the components that have to be joined, in particular at the points of separation for the process air ducting.

Furthermore, the aforementioned solutions share the common drawback that, in order to avoid energy losses and the escape of moisture, additional seals have to be inserted at the separation points of the components that have to be joined, in particular at the points of separation for the process air ducting.

SUMMARY OF THE INVENTION

The object of the invention is to provide a base module for a condenser tumble-dryer of the type mentioned in the introduction, which module is suitable as a load-bearing body and has high stability whilst maintaining the necessary functions and achieves a flow-favorable and air-tight process air ducting. The object of the invention is also to provide with the new design an altogether more rational manufacturing of the condenser tumble-dryer.

The object of the invention is achieved by the features set out in the claims in such a way that the base module is configured as a compact uniform plastic body for all the components listed and has separating surfaces for connection to the components located at the front and back, which surfaces are each essentially located in at least one perpendicular plane or in at least two perpendicular planes that are offset in a staggered manner in relation to each other.

According to the invention, the base module that serves to accommodate the functional parts and air ducting components is additionally configured as part of the load-bearing structure. For this purpose, the base module has perpendicular separating surfaces for the end plate at the front and the process air cover at the back. The separating surfaces are designed to be extensive and preferably extend over the entire width of the tumble-dryer. It is also an essential feature of the invention that the sub-assemblies are joined and connected without any sealing means. The process air ducting through the base module is achieved via the heat exchanger which is located at the exit of the area in which it is accommodated closely adjacent to an impact-free and seamless contact surface in the base module. The space that accommodates the heat exchanger is configured as a cooling air conduction duct and, just like the housing for the cooling air fan, is sealed off by a lock-on cover. The lock-on covers provide completely adequate air-tightness for the cooling air ducts. The use of sealing means is therefore likewise unnecessary at these connection points.

Compared to the aforementioned known solutions, considerable advantages are achievable with the base module according to the invention, with respect to the mechanical stability thereof as a uniform plastic body and as a part of the whole supporting structure, with respect to an effective ducting of the airstreams and of the manufacture of the individual parts and the assembly thereof in the final assembly stage.

Advantageous embodiments of the invention are also defined.

BRIEF DESCRIPTION OF THE DRAWINGS

The invention and the advantages thereof are described in greater detail below with reference to an exemplary embodiment shown in the drawing. The drawing shows.

DETAILED DESCRIPTION OF THE EXEMPLARY EMBODIMENTS OF THE PRESENT INVENTION

Figure 1:
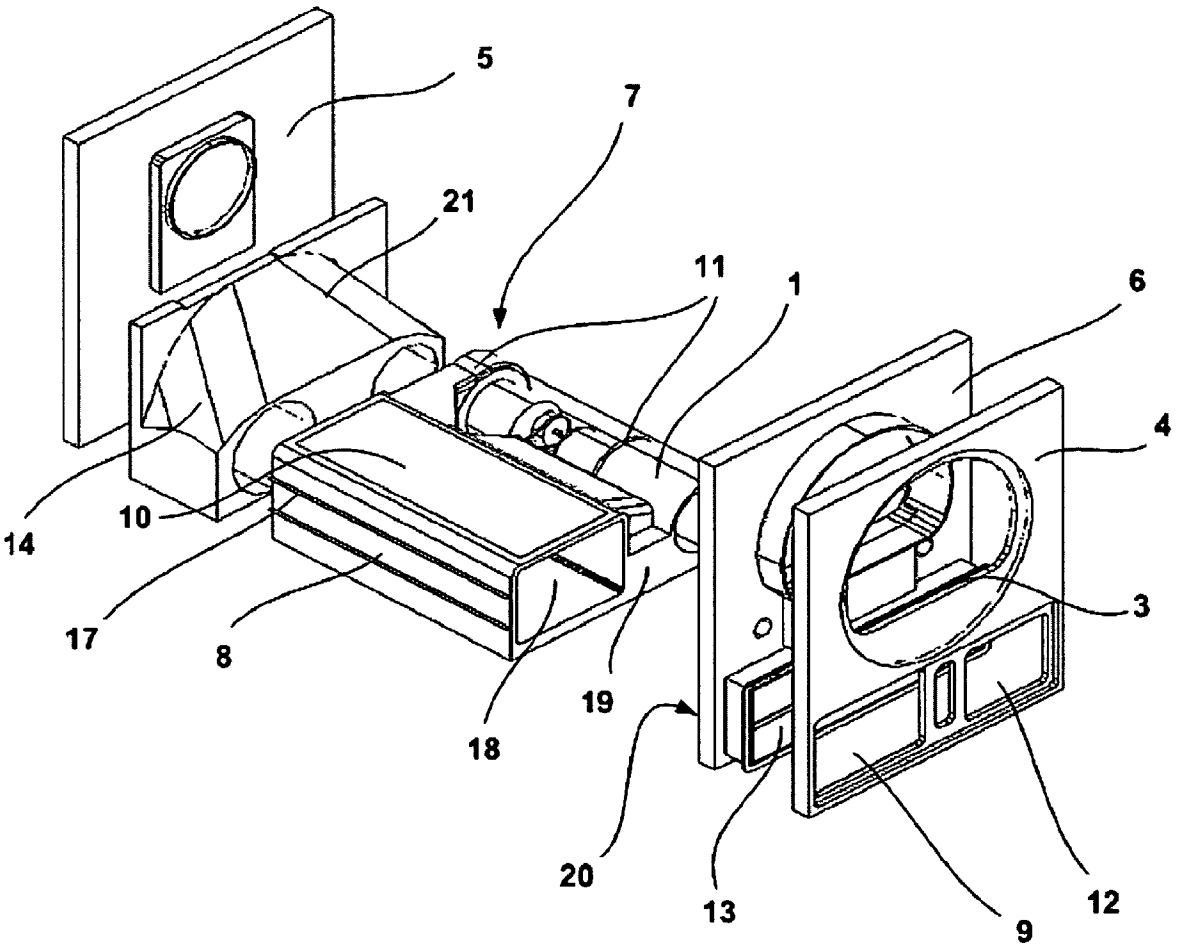
FIG. 1 the base module of a condenser tumble-dryer in an exploded view.
Figure 2:
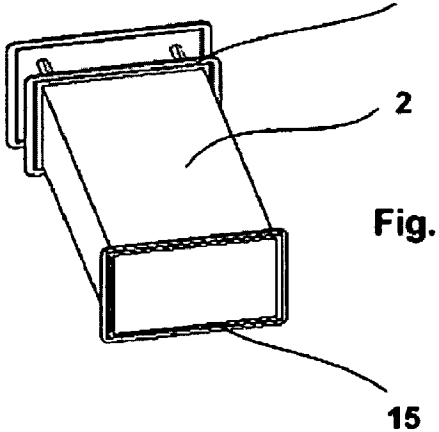
FIG. 2 a heat exchanger for insertion into the space that is provided to accommodate it.

The base module 7 is a compact plastic body produced by the injection molding process, which body achieves high rigidity by its design and by the ribs 17 that are additionally molded therein in the base area (not visible) and at the sides. Molded into the base module are a space 18 to accommodate the heat exchanger 2 of the condenser 8 and further facilities for accommodating the drive motor and the fan wheels of the process air and cooling air fan 11. The base module 7 is completed by a cover 10, which seals off at the top the space 8 that accommodates the heat exchanger and a second cover 1, which forms the housing for the cooling air fan together with the lower part which is molded into the base module.

Even without known sub-assemblies or supporting angles and supporting rails that provide rigidity, the base module 7 has very high stability and is rigid and torsion-resistant. The base module 7 incorporates the whole width of the tumble-dryer and in the lower region of the device it forms a lateral frame for side walls that are fastened by means of screws (not shown). Unlike known tumble-dryers, the base module 7 is designed to have less depth and has separating surfaces 19, 20 which are perpendicular to the components that are adjacent to the front and back. At the front the base module 7 is locked and screwed in place with the composite body that is made up of the end plate 6 and front wall 4 and at the back it is welded onto the process air cover 14 which likewise has ribs 21 on its outer side.

The front and rear separating surfaces of the base module 7 are each located in a perpendicular plane and are designed to be as extensive as possible, which gives the connections to the endplate 6 and to the process air cover 14 such high stability that the tumble-dryer withstands all the mechanical loads that are exerted during operation and transport without the conventional supporting structures having to be used.

The process air flows through the base module 7 in the heat exchanger 2 from the front to the back. For this purpose, the accommodation space 18 in the base module 7 has at the back, on the inside, a seamless and impact-free contact surface against which the heat exchanger 2, which has been inserted and locked in place, fits closely and in a manner whereby it is subjected to pressure. The connection is sealed by an annular seal 15 which is fixed to the heat exchanger 2. The tightness of the process air ducting is achieved at the front by a second annular seal 16 that is circumferentially attached to the heat exchanger 2. When the heat exchanger 2 has been inserted and locked in place, said seal sits close to the limiting edge of the process air aperture 13 that is molded into the end plate 6.

The cooling air is sucked up through the air inlet aperture 12 in the front wall 4 of the tumble-dryer by the cooling air fan, flows through the heat exchanger 2 in the accommodation space 18 transverse to the direction of the process air flow and from there is further directed through an air outlet aperture that is not shown out into the surrounding space. The cooling air is directed in the area of the cooling air fan and accommodation space 18 through each cover 1 on the cooling air fan and 10 on the accommodation space 18. Both covers 1, 10 are inserted from above and are locked to the base module 7 by exerting perpendicular pressure. The cover 10 for accommodation space 18 provides a flush seal with the outer face of the base module 7. The styling of the cover aperture and the locking means are designed in such a way that the rigidity of the base module 7 is additionally reinforced when the cover 10 is fixed in place. Sufficient air-tightness for the ducting of the cooling air is achieved by means of the lock connection without using additional sealing means.

There are technical reasons for the use of the covers 1, 10 as separate production components because the spaces for the cooling fan and accommodation space 18 cannot be manufactured in one piece with the base module 7. Otherwise it would not be possible to fit either a condensate collection tray or a condensate pump or the cooling air fan wheel (all of which are not shown here). According to the invention, the division of the base module 7 into the necessary minimum number of individual parts is carried out in such a way that the only areas that are joined are areas of cooling air ducting. In this way the constraints and restrictions resulting from assembly requirements do not have any negative effect on the air-tightness of the process air duct or on the function of the tumble-dryer as a whole.

Considerable advantages also emerge from the application of the invention during the final assembly of the tumble-dryer. The number of individual parts that have to be fitted is minimal, in particular as a result of avoiding sealing elements at the separating surfaces of the sub-assemblies. These separating surfaces can be designed to be very smooth and—when fixed together—form surfaces that lie very close together, making any additional sealing measures unnecessary. Equipping the base module 7 with the functional parts for the fan, collection tray and condensate pump and fitting and locking the covers 1, 10 are operational steps that are easy to carry out.

REFERENCE SIGNS

1. Cover for cooling air fan
2. Heat exchanger
3. Lint screen
4. Front wall
5. Back wall
6. End plate
7. Base module
8. Condenser
9. Aperture for insertion of heat exchanger
10. Cover for condenser housing
11. Process air and cooling air fan
12. Aperture for intake of cooling air
13. Aperture for process air duct
14. Process air cover
15. First sealing collar
16. Second sealing collar
17. Ribs on condenser housing
18. Accommodation space for heat exchanger
19. Separating surface on base module
20. Separating surface on front sub-assembly
21. Ribs on process air cover

The invention claimed is:

1. A condenser tumble-dryer comprising:
components including:
an air-cooled condenser with a heat-exchanger;
a drive motor for a clothes drum and for a fan for a process air and a cooling air;
ducts and conduit facilities for both airstreams;
a condensate collection tray; and
a condensate pump; and
a base module which is made of plastic and which serves as part of a supporting structure of the tumble-dryer, accommodation facilities being molded into the base module, the base module being configured as a compact uniform plastic body for all said components and having separating surfaces for connection to front and rear components, each of which surfaces is essentially located in at least one perpendicular plane or in at least two perpendicular planes that are offset in a staggered manner in relation to each other.

2. The tumble-dryer as claimed in claim 1, further comprising stiffeners and/or ribs molded into the base module in a base and in lateral faces.

3. The tumble-dryer as claimed in claim 1, wherein the base module includes a cover providing a seal for the cooling air fan and for the space that accommodates the heat exchanger.

4. The tumble-dryer as claimed in claim 1, wherein the base module is connected in a seal-free manner to the front and back components via the perpendicular separating surfaces.

5. The tumble-dryer as claimed in claim 1, wherein the perpendicular separating surfaces are extensive and extend across substantially an entire width of the tumble-dryer.

6. The tumble-dryer as claimed in claim 1, wherein the accommodation space for the heat exchanger, which space is molded into the base module, is configured as a cooling air conduction duct.

7. The tumble-dryer as claimed in claim 1, wherein the accommodation space molded into the base module has at an outlet end an annular impact-free and seamless contact surface for the heat exchanger.

8. The tumble-dryer as claimed in claim 1, wherein the accommodation space for the heat exchanger, which space is molded into the base module can be sealed by a cover that is manufactured as a separate component, the cover providing a flush seal with an outer face of the base module when fixed in position.

9. The tumble-dryer as claimed in claim 3, wherein for the purpose of joining the parts together, the cover or covers can be inserted from above and in an operating position are connected to the base module by locking

10. The tumble-dryer as claimed in claim 1, wherein the front component includes a front endplate of the tumble-dryer, and
wherein the rear component includes a process air cover of the tumble-dryer.

11. The tumble-dryer as claimed in claim 1, wherein the base module includes:
a first molded space that accommodates the heat exchanger; and
a first cover that seals the first molded space within the base module, wherein the first cover is coupled to an upper surface of the base module and locked onto the base module.

12. The tumble-dryer as claimed in claim 1, wherein the base module includes:

a second molded space that accommodates the cooling air fan; and a second cover that seals the second molded space within the base module, wherein the second cover is coupled to an upper surface of the base module and locked onto the base module.

13. The tumble-dryer as claimed in claim 1, wherein the base module includes:

a first molded space that accommodates the heat exchanger and a first cover that seals the first molded space within the base module; and a second molded space that accommodates the cooling air fan and a second cover that seals the second molded space within the base module, wherein each of the first cover and the second cover is coupled to an upper surface of the base module and locked onto the base module.

14. The tumble-dryer as claimed in claim 13, wherein the first cover and the second cover are flush with the upper surface of the base module when locked onto the base module.

15. The tumble-dryer as claimed in claim 1, wherein the base module forms the supporting structure of the tumble-dryer, and wherein the base module extends across substantially an entire width of the tumble-dryer.

16. The tumble-dryer as claimed in claim 15, wherein the base module includes:

a first molded space that accommodates the heat exchanger; and a second molded space that accommodates the cooling air fan, wherein each of the first molded space and the second molded space extend through the base module in a direction transverse to the width of the tumble-dryer.

17. The tumble-dryer as claimed in claim 16, comprising:

a first cover that seals the first molded space within the base module; and a second cover that seals the second molded space within the base module, wherein each of the first cover and the second cover is coupled to an upper surface of the base module and locked onto the base module.

18. A condenser tumble-dryer comprising:

an air-cooled condenser with a heat-exchanger;

a drive motor for a clothes drum and for a fan for a process air and a cooling air;

ducts and conduit facilities for airstreams of both the process air and the cooling air;

a condensate collection tray;

a condensate pump; and a plastic base module forming a supporting structure of the tumble-dryer, the plastic base module having separating surfaces for connection to front and rear components of the condenser tumble-dryer, wherein each of the separating surfaces is substantially located in at least one perpendicular plane or in at least two perpendicular planes that are offset in a staggered manner in relation to each other, and wherein the plastic base module includes molded accommodation facilities forming a compact uniform plastic body for the air-cooled condenser with the heat-exchanger, the drive motor for the clothes drum and for the fan for the process air and the cooling air, the ducts and the conduit facilities for the airstreams of both the process air and the cooling air, the condensate collection tray, and the condensate pump.

19. The tumble-dryer as claimed in claim 18, wherein the molded accommodation facilities of the base module include:

a plurality of molded spaces that accommodate the air-cooled condenser with the heat-exchanger, the drive motor for the clothes drum and for the fan for the process air and the cooling air, the ducts and the conduit facilities for the airstreams of both the process air and the cooling air, the condensate collection tray, and/or the condensate pump.

* * * * *